US009541236B2

(12) United States Patent
Kuehl et al.

(10) Patent No.: US 9,541,236 B2
(45) Date of Patent: Jan. 10, 2017

(54) MULTI-STAGE HOME REFUELING APPLIANCE AND METHOD FOR SUPPLYING COMPRESSED NATURAL GAS

(71) Applicant: Whirlpool Corporation, Benton Harbor, MI (US)

(72) Inventors: Steven J. Kuehl, Stevensville, MI (US); Nihat O. Cur, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 719 days.

(21) Appl. No.: 13/940,950

(22) Filed: Jul. 12, 2013

(65) Prior Publication Data

US 2015/0013829 A1 Jan. 15, 2015

(51) Int. Cl.
*B65B 31/00* (2006.01)
*F17C 5/06* (2006.01)

(52) U.S. Cl.
CPC ..... *F17C 5/06* (2013.01); *F17C 2221/033* (2013.01); *F17C 2225/0123* (2013.01); *F17C 2225/036* (2013.01); *F17C 2227/0157* (2013.01); *F17C 2227/0164* (2013.01); *F17C 2260/025* (2013.01); *F17C 2265/065* (2013.01); *F17C 2270/0178* (2013.01); *F17C 2270/07* (2013.01)

(58) Field of Classification Search
CPC ..... F17C 2225/036; F17C 2227/0157; F17C 2227/0164; F17C 2260/025; F17C 2265/065; F17C 2270/0178; F17C 2270/07
USPC ..... 141/4
See application file for complete search history.

(56) References Cited

U.S. PATENT DOCUMENTS

| | | | | |
|---|---|---|---|---|
| 4,139,019 | A * | 2/1979 | Bresie | F17C 5/002 137/351 |
| 5,002,203 | A | 3/1991 | Einer | |
| 5,603,360 | A | 2/1997 | Teel | |
| 5,676,180 | A * | 10/1997 | Teel | F17C 5/06 137/267 |
| 5,863,186 | A | 1/1999 | Green et al. | |
| 5,908,141 | A * | 6/1999 | Teel | F17C 5/06 141/18 |
| 6,427,729 | B1 | 8/2002 | Teel | |
| 6,568,911 | B1 | 5/2003 | Brightwell et al. | |
| 6,899,115 | B1 * | 5/2005 | Adler | F17C 5/06 137/13 |
| 7,431,033 | B2 | 10/2008 | Downie et al. | |
| 7,637,285 | B2 | 12/2009 | Weber | |
| 2008/0008602 | A1 * | 1/2008 | Pozivil | F28F 27/02 417/243 |

(Continued)

FOREIGN PATENT DOCUMENTS

| | | |
|---|---|---|
| DE | 29816811 U1 | 10/1999 |
| DE | 102007004456 A1 | 7/2008 |

(Continued)

*Primary Examiner* — Jason K Niesz

(57) ABSTRACT

A multi-stage home refueling appliance and method supplying compressed natural gas from a utility natural gas supply. The multi-stage home refueling appliance includes a first compressing stage having a first stage inlet fluidly coupled to the supply of natural gas and a first stage outlet, a second compressing stage having a second stage inlet fluidly coupled to the first stage outlet and a second stage outlet and a vehicle refueling dispenser fluidly coupled to the second stage outlet and configured to be selectively fluidly coupled to a storage tank of a vehicle.

38 Claims, 4 Drawing Sheets

(56) References Cited

U.S. PATENT DOCUMENTS

| | | | | |
|---|---|---|---|---|
| 2008/0128029 | A1* | 6/2008 | Gorman | F02C 6/16 137/209 |
| 2011/0240139 | A1* | 10/2011 | Ding | F17C 5/007 137/171 |
| 2014/0102587 | A1* | 4/2014 | Nagura | H01M 8/04208 141/69 |

FOREIGN PATENT DOCUMENTS

| | | | |
|---|---|---|---|
| DE | 102007049458 | A1 | 4/2009 |
| DE | 102011010869 | A1 | 8/2012 |
| EP | 1041337 | A2 | 10/2000 |
| WO | 2008053238 | A2 | 5/2005 |
| WO | 2010105306 | A1 | 9/2010 |
| WO | 2012107756 | A1 | 6/2012 |

* cited by examiner

MULTI-STAGE HOME REFUELING APPLIANCE AND METHOD FOR SUPPLYING COMPRESSED NATURAL GAS

BACKGROUND OF THE INVENTION

Contemporary vehicles may be equipped to use compressed natural gas (CNG) as an alternative fuel. In order to store a sufficient volume of natural gas in a container commensurate in size to the fuel tank of a contemporary vehicle using gasoline or diesel while providing a range of travel commensurate to that of a contemporary vehicle the natural gas may need to be compressed to a pressure of about 3600 psig or higher. As natural gas is generally provided to a home at 3 psig, the need to have over a 1000 fold increase in the pressure creates many difficulties in building a home CNG refueling appliance, especially when most current CNG vehicle refueling systems are commercial or industrial sized systems, which utilize mechanical compressors that have significant cost and complexity to manufacture and maintain and are not suitable for use in a home environment.

BRIEF DESCRIPTION OF THE INVENTION

In one aspect, the invention relates to a multi-stage home refueling appliance for supplying compressed natural gas (CNG) from a utility natural gas supply, having a first compressing stage comprising a mechanical pre-compressor having a first stage inlet fluidly coupled to the supply of natural gas and a first stage outlet, a second compressing stage comprising a hydraulic compressor having a second stage inlet fluidly coupled to the first stage outlet and a second stage outlet, and a vehicle refueling dispenser fluidly coupled to the second stage outlet and configured to be selectively fluidly coupled to a storage tank of a vehicle, wherein the first compressing stage is configured to mechanically compress the supplied natural gas to a first pressure, and the second compressing stage is configured to hydraulically compress the natural gas from the first compressing stage to a second pressure, greater than the first pressure.

In another aspect, the invention relates to a method of providing compressed natural gas suitable for use in a vehicle multi-stage home refueling appliance from a utility supply of natural gas, the method includes mechanically pre-compressing the supply of natural gas to a first pressure by a mechanical compressor in the multi-stage home refueling appliance and hydraulically compressing the pre-compressed natural gas to a second pressure, greater than the first pressure by a hydraulic compressor in the multi-stage home appliance.

DESCRIPTION OF EMBODIMENTS OF THE INVENTION

Figure 1:
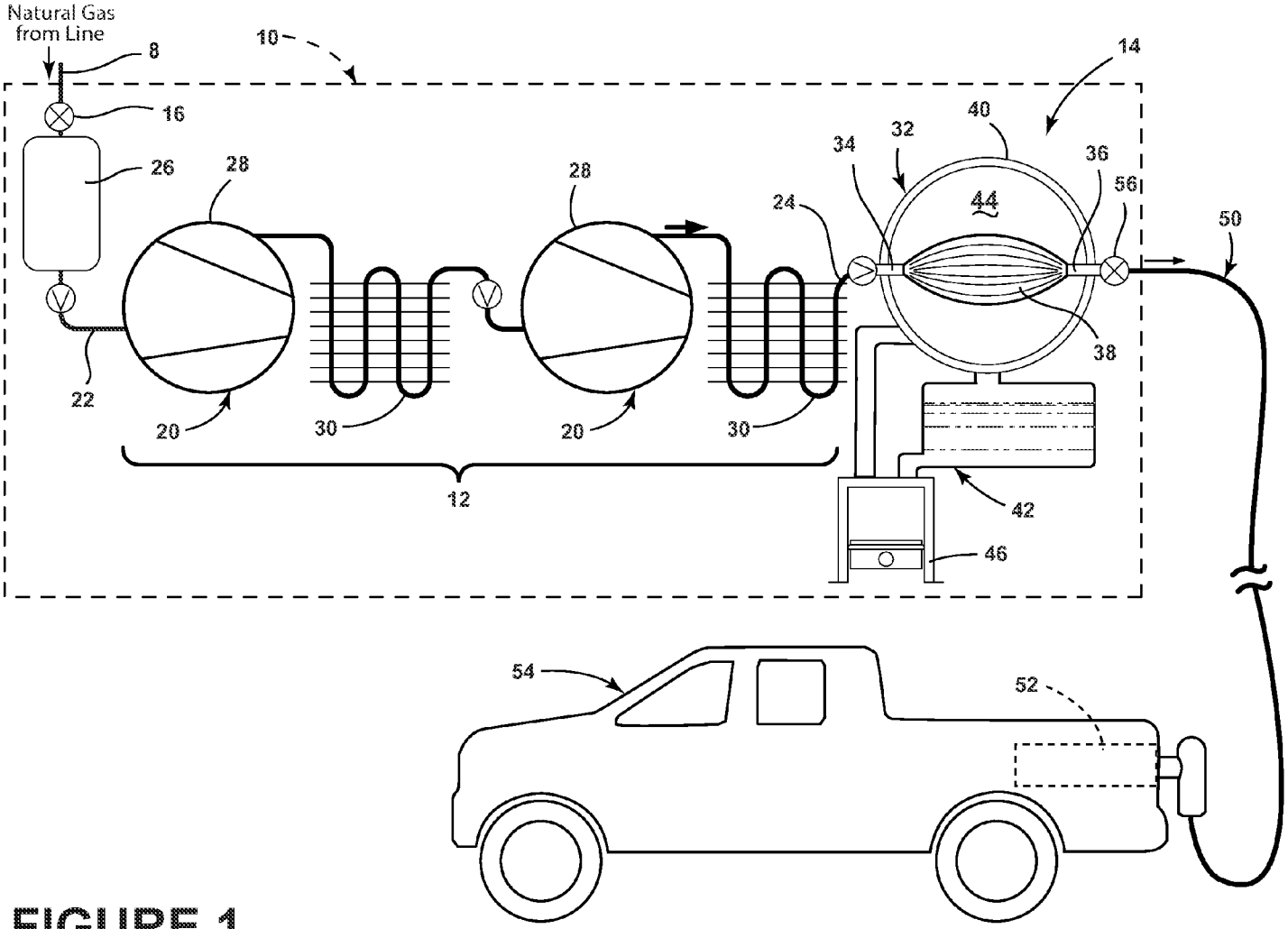
FIG. 1 is a schematic view of a multi-stage home refueling appliance according to an embodiment of the invention.

Prior to describing the embodiments of the invention, an overview of the home CNG fueling environment will be helpful in understanding the difficultly of developing a home refueling appliance. Unlike commercial/industrial refueling systems, home refueling appliances have a variety of unique constraints placed on them, which makes commercial/industrial systems generally inapplicable to home CNG fueling solutions. That is, one cannot merely scale down a commercial/industrial system and have it result in a commercially viable home refueling appliance. Compressed natural gas is supplied to the home at 3 psig and must be compressed to the current automobile standard of 3600 psig, which is expected to increase to 5000 psig in the future. Automobiles must be able to store enough CNG to travel at least 200 miles. Based on a "gallon of gas equivalent" of 2.567 kg, which, at 3600 psig, is, 115.2 liters (at standard temperature) and equivalent to about 8 gallons (30.2 Liters) of liquid gasoline. Two hundred miles is a minimum amount. For many consumers, a greater amount, such as enough to travel 300 to 400 miles is more desirable.

Home CNG re-fueling appliances must also be able to fill the vehicle tank in a predetermined time, which preferably is at least overnight. The energy consumed in the pressurization from 3 psig to 3600 psig must not be so great as to remove the cost advantage of CNG over gasoline. Further, regulations limit the in process volume capacity of any home CNG re-fueling appliance such that if all of the gas escaped, the escaped gas would not exceed 5% of the total volume of the room, typically a garage, in which the fueling system is located. In the case of a one-car garage, which has a standard size of 12×22×10, resulting in a volume of 2640 $ft^3$, 5% of which is 132 $ft^3$ (about 3800 Liters) of air at STP. The 115.2 Liters of gas at 3600 psig, which is required to go 200 miles, will expand to approximately 28800 Liters at STP, which is 7.5 times the permitted amount for a one-car garage. Thus, storage of CNG off vehicle is not allowed at elevated pressures (greater than ~3-5 psi) other than on vehicle per fire safety code NFPA 52. Thus, it is desired to minimize the compression system process volume. The storage constraints and refueling time constraints place contradicting constraints on the home refueling system. Thus, when it is not possible to store an amount sufficient to refuel a single tank, the home refueling appliance must be able to compress the fuel needed for a full tank within the time required to refuel, and it must be able to do this without foregoing the energy cost advantage of CNG over gasoline.

The home CNG refueling appliances may also be subject to additional constraints. For example, there may be a limit on the hoop strength of an encasement included in the home CNG refueling appliance. This may put a practical limit on the size of the encasement, which would also put a limit on a size of a bladder located within the encasement. The target flow rate is 0.36 liters per minute at 3600 psi to get 8 gallons of gas equivalent in less than 6 hours. If the pressure ratio for the bladder portion of the compression unit is 10:1 then the gas flow rate would be 3.6 liters per minute. For the use of a single pressure vessel or encasement the bladder volume may be in the range of 10-20 cm in nominal diameter with a volume of 0.2-4 liters. For a cylindrical system a single cylinder may be 4-11 cm nominal diameter with 30-50 cm length. A continuous flow system may require at least two compression encasements and a bladder would likely be 0.25-2.5 liters in volume but limited to 5.0 liters due to the air fuel ratio allowable in case of leakage during shutdown of the appliance. The bladder volume may be limited by heat transfer surface areas of a given encasement. This would tend to drive towards multiple vessels of smaller volume used in parallel. The hoop stresses would be within a range of these dimensions if using a suitable low cost formable material such as wrought steel formed into seamless pipe or cast into shells.

FIG. 1 illustrates a multi-stage home refueling appliance 10 for supplying compressed natural gas (CNG) and which is capable of meeting the constraints placed on a home refueling appliance. The home refueling appliance 10 utilizes a first compressing stage 12 and a second compressing stage 14. The multi-stage home refueling appliance 10 may be fluidly coupled to a home utility natural gas supply 8, traditionally supplies natural gas at 3 psig. A valve 16 may be used to selectively fluidly couple the home utility natural gas supply 8 to the multi-stage home refueling appliance 10. The first compressing stage compresses the natural gas from the natural gas supply pressure to an intermediate pressure, and the second compressing stage 14 compresses the natural gas from the intermediate pressure to a final pressure, which is the pressure to be supplied to the vehicle.

As illustrated in FIG. 1, the first compressing stage 12 may be a mechanical compressing stage including at least one mechanical pre-compressor 20 such as a high pressure compressor having a first stage inlet 22 fluidly coupled to the home utility natural gas supply 8 and a first stage outlet 24 may be included in the first compressing stage 12. An optional filter/dryer 26 may be included in the multi-stage home refueling appliance 10 and may be fluidly coupled between the home utility natural gas supply 8 and the first stage inlet 22. The filter/dryer 26 may be replaceable by a user. The filter/dryer 26 may filter impurities and remove moisture from the natural gas delivered from the home utility natural gas supply 8. It is also contemplated that separate components may provide the filtering and drying and that such components may be fluidly coupled between the home utility natural gas supply 8 and the first stage inlet 22.

The mechanical pre-compressor 20 has been illustrated as having multiple mechanical compressors 28 fluidly coupled in series. Inter-stage coolers 30 may be included after each of the multiple mechanical compressors 28. Multiple, in-series mechanical compressors are not required. Alternatively, a single pre-compressor or multiple lines of parallel compressor(s) may be used. The multiple, in-series compressors provide a cost advantage in that simple and readily available compressors may be used. The mechanical pre-compressor 20 may include any suitable type of mechanical pre-compressor including that the mechanical pre-compressor 20 may include at least one hermetic refrigerant like compressor. In the illustrated example, the mechanical pre-compressor 20 may include series linked hermetic refrigerant like compressors. For example, the mechanical pre-compressor 20 may include $CO_2$ style refrigerant compressors modified for high gas throughput by increasing piston displacement and designing compressor cylinder valves to handle natural gas contaminants.

The second compressing stage may be in the form of a hydraulic compressing stage having at least one hydraulic compressor 32 having a second stage inlet 34 fluidly coupled to the first stage outlet 24 and having a second stage outlet 36. The hydraulic compressor 32 may be any suitable type of hydraulic compressor including a liquid piston compressor. An inflatable bladder 38, an encasement 40, and a source of hydraulic fluid 42 may be included in the hydraulic compressor 32. The source of hydraulic fluid 42 may be fluidically isolated from the high pressures obtained in encasement 40 via a valve and conduit (not shown) deployed between the encasement 40 and hydraulic fluid source 42. The inflatable bladder 38 may be fluidly coupled between the second stage inlet 34 and the second stage outlet 36. The encasement 40 may surround the inflatable bladder 38 and may define a chamber 44 in which the inflatable bladder 38 may be received. The source of hydraulic fluid 42 may be fluidly coupled to the chamber 44, such as through a high pressure hydraulic pump 46, for compressing the inflatable bladder 38 from an inflated state to a deflated state. While the inflatable bladder 38 may be inflatable by unfolding portions of the inflatable bladder it is contemplated that the inflatable bladder 38 may be unexpandable meaning that it will not stretch, which may not be desirable at the expected pressures of 3600 psig or greater. It is conceived that the gas and hydraulic working fluid may operate on either side of the collapsible bladder. Thus, the gas could be introduced into encasement 40 and the working fluid into the bladder to compress the gas within the encasement to the desired pressurization.

It is contemplated that the encasement 40 and the bladder 38 may be sized to conform to the constraints placed on home CNG fueling appliances. For example, the encasement 40 may be sized to hold 3.6 liters or less of CNG at a desired pressure range such as between 3600 psig and 5000 psig. By way of further example, the inflatable bladder 38 may be a 3.6 Liter inflatable bladder. It is anticipated that the bladder would fill the entire volume of the encasement during operation to minimize swept volume losses. Additionally, the bladder may actually be slightly larger in volume than the encasement volume so as to prevent over inflation and the elastomeric stressing of the bladder material. Alternatively, a 5 Liter encasement and a 5 Liter bladder may be used.

A vehicle refueling dispenser 50 may be fluidly coupled to the second stage outlet 36 and configured to be selectively fluidly coupled to a storage tank 52 of a vehicle 54. The dispenser 50 may be configured to fill the storage tank 52 until it achieves a predetermined pressure, such as 3600 psig. A regulator valve 56 may be fluidly coupled upstream of the refueling dispenser 50. The regulator valve 56 may be located at the second stage outlet 36 and may be configured to provide gas to the vehicle storage tank 52 while the hydraulic pump 46 may be controlled so as to maintain the discharge pressure from the encasement 40 above the vehicle fuel tank pressure.

During operation, the first compressing stage 12 may be configured to mechanically compress the supplied natural gas to a first pressure, which for this example is 3 psig to 360 psig, and the second compressing stage 14 may be configured to hydraulically compress the natural gas from the first compressing stage to a second pressure, greater than the first pressure, which for this example is 3600 psig. Alternatively, in this example, the pressures can be thought of as the first compressing stage 12 compresses the natural gas from the natural gas supply 8 by at least a 10 fold increase in pressure and the second compressing stage 14 compresses the natural gas by another 10 fold increase in pressure.

More specifically, the mechanical pre-compressor 20 steps the natural gas to a pressure of 360 psig. For example, the first of the illustrated multiple mechanical compressors 28 may step the pressure of the natural gas to 200 psig and the second of the illustrated multiple mechanical compressors 28 may step the pressure of the natural gas to 360 psig. Depending on the capacity of the mechanical compressors and the desired first pressure, fewer or more than two mechanical compressors 28 may be used.

Figure 3:
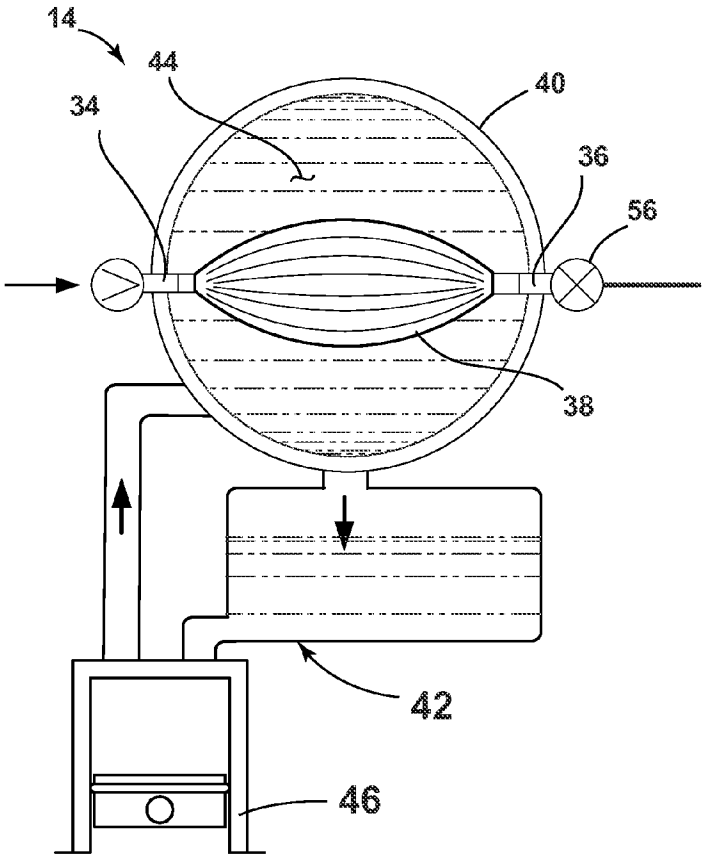
FIG. 3 is a schematic view of a hydraulic compressor of the multi-stage home refueling appliance of FIG. 1 with the inflatable bladder in a deflated state.
Figure 2:
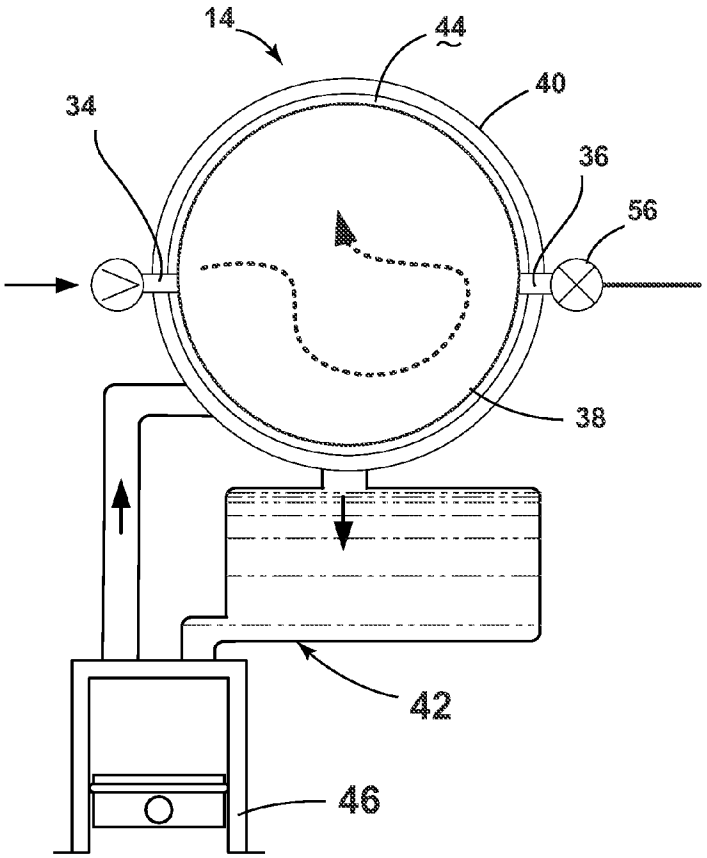
FIG. 2 is a schematic view of a hydraulic compressor of the multi-stage home refueling appliance of FIG. 1 with an inflatable bladder in an inflated state.

The compressed natural gas at 360 psig may then enter the inflatable bladder 38 until the inflatable bladder 38 may be in an inflated state as shown in FIG. 2. Hydraulic fluid may then be pumped into the chamber 44 of the encasement 40 and the CNG may be reduced in volume to 1 Liter at 3600 psig as shown in FIG. 3. In this manner the natural gas may be supplied from the home natural gas line at 3 psig and may be compressed by the multi-stage home refueling appliance 10 to 3600 psig. However, the increase in NG gas pressure required depends on the vehicle fuel tank pressure at any time during a re-fueling. The multi-stage home refueling appliance 10 may also be configured to supply at least 8 gallons of gas equivalent of CNG over a predetermined time period, such as six hours. The typical industry standard for CNG fueling system pressure is 3600 psig and thus this embodiment has been described with respect to compressing the natural gas to 3600 psig; however, it will be understood that the multi-stage home refueling appliance 10 may be utilized to compress the natural gas upwards of 5000 psig.

It will be noted that bladder 38 contains 3.6 Liter of CNG at 360 psig (24.5 atms) before hydraulic compression and that the vehicle requires at least 115.2 Liters of CNG at 3600 psig (245 atms or bars) to fill the vehicle tank 52. Thus, it is necessary in this embodiment for the compressors used in the different stages to complete this cycle at least 320 times within the predetermined time to meet the home constraints. It is also noted that the greatest maximum storage of CNG is 3.6 Liter at 360 psig, which equals a volume of approximately 88.2 Liters at STP (1 atm), which meets the 5% constraint for the one-car garage, which is the anticipated extreme room constraint. This embodiment also will not provide for the continuous flow of CNG to the vehicle because once the CNG in the bladder is dispensed into the vehicle, no more CNG is available for dispensing until the system completes another cycle and fills the bladder 38 again. Thus, the cycle time of compression from 3 psig to 3600 psig is a system driver for the first embodiment.

Figure 4:
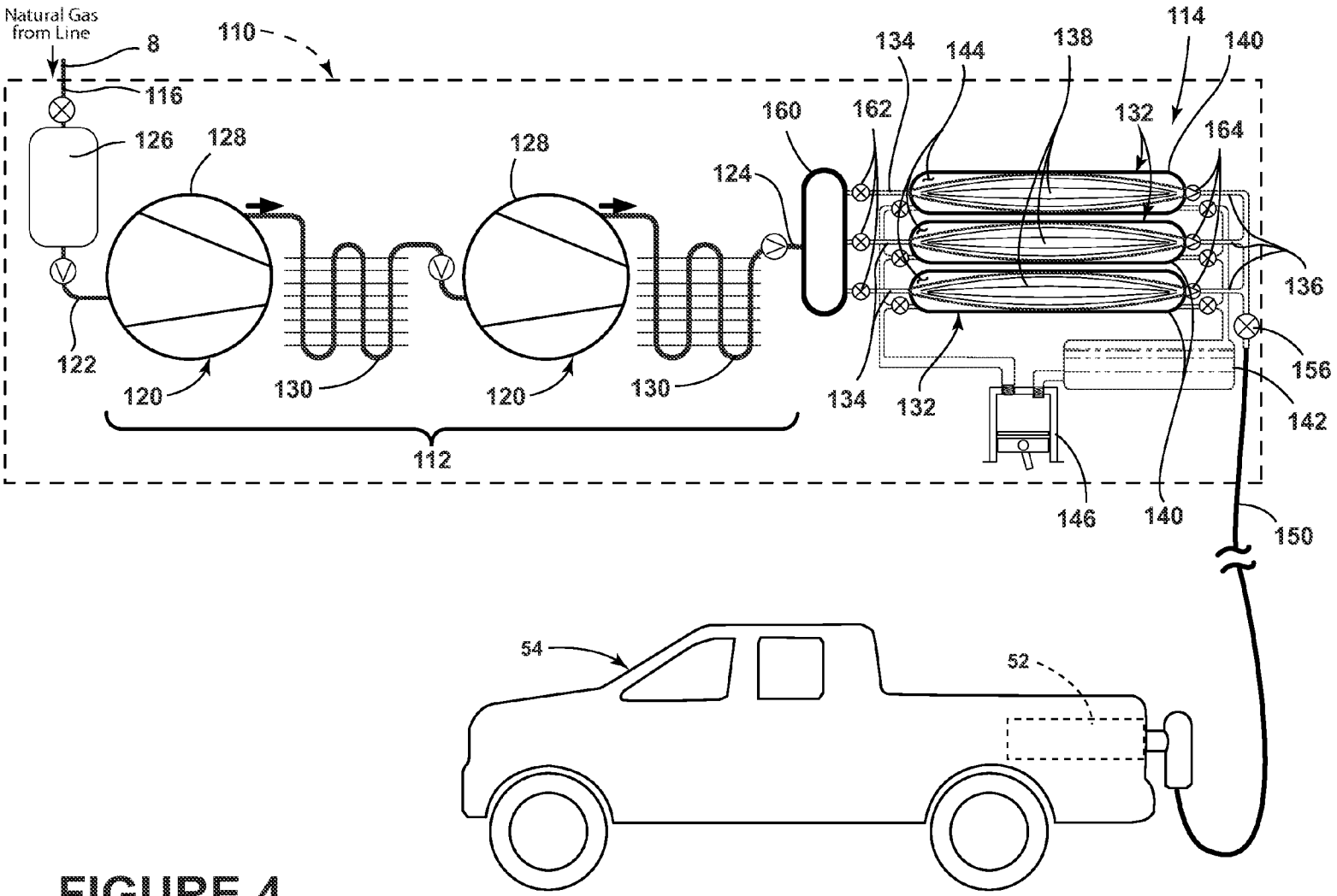
FIG. 4 is a schematic view of a multi-stage home refueling appliance according to another embodiment of the invention.

FIG. 4 illustrates an alternative multi-stage home refueling appliance 110 having multiple hydraulic compressors 132. The multi-stage home refueling appliance 110 is similar to the multi-stage home refueling appliance 10 previously described and therefore, like parts will be identified with like numerals increased by 100, with it being understood that the description of the like parts of the multi-stage home refueling appliance 10 applies to the multi-stage home refueling appliance 110, unless otherwise noted.

The multiple hydraulic compressors 132 are fluidly arranged in parallel between the first compressing stage 112 and the vehicle refueling dispenser 150. A manifold 160 may be located at the second stage inlet 134 and may be used along with various control valves 162 to distribute the CNG between the multiple hydraulic compressors 132. Each of the multiple hydraulic compressors 132 may include an inflatable bladder 138 for storing the CNG. Separate encasements 140 may surround each of the inflatable bladders 138 and may each define a chamber 144 in which an inflatable bladder 138 may be received. A check valve 164 may be located at the second stage outlet 136 of each of the multiple hydraulic compressors 132 such that each check valve 164 may selectively fluidly couple the second stage outlet 136 to the vehicle refueling dispenser 150. Various valves 170 may also be included to fluidly couple the source of hydraulic fluid 142 to the various chambers 144 formed by the encasements 140. It is additionally conceived that the gas and hydraulic working fluid may operate on either side of the inflatable bladders 138. Thus, the gas could be introduced into encasement 140 and the working fluid into the inflatable bladders 138 to compress the gas within the encasement 140 to the desired pressurization. Further, heat transfer from the gas undergoing compression may be required for optimal performance and may be accomplished through the encasement walls with typical heat transfer enhancements such as extended surfaces and cooling jackets if the gas is outside of the bladder 138 but confined by the encasement 140. If the gas is contained within the inflatable bladders 138, then a means of heat transfer may be required such as via insertion of a cooling loop or water mist sprayed into the inflatable bladder 138 containing the gas under compression.

It is contemplated that the multiple hydraulic compressors 132 may be operated in sequence to provide a substantially continuous flow of CNG to the vehicle tank 52. This embodiment will reduce the amount of time needed to fill the vehicle tank, as compared to the first embodiment, assuming all of the bladders 38 are not empty at the time the vehicle tank fueling begins.

As with the earlier embodiment the multiple hydraulic compressors 132 may be sized to conform to the constraints placed on home CNG fueling appliances. For example, the multiple hydraulic compressors 132 may be sized such that combined they hold 3.6 liters or less of CNG at a desired pressure range. The smaller size of the encasements 140 may lower the hoop stress of each encasement 140. By way of further example, if two multiple hydraulic compressors 132 are used each of the inflatable bladders 138 may be a 1.8 Liter inflatable bladder 138. In this manner, each of the inflatable bladders 138 may be inflated to a predetermined maximum volume up to the volume of the encasement. The multi-stage home refueling appliance 110 may also be configured to supply at least 8 gallons of gas equivalent of CNG over a predetermined time period, such as six hours.

Figure 5:
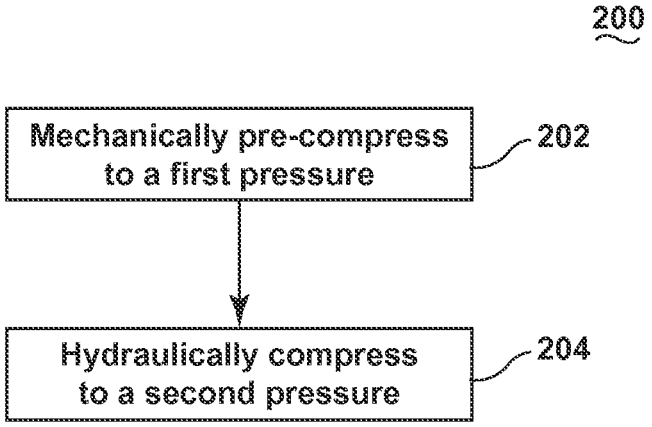
FIG. 5 is a flow chart showing a method of providing compressed natural gas suitable for use in a vehicle by a multi-stage home refueling appliance from a utility supply of natural gas according to an embodiment of the invention.

Assuming that each of the bladders 38 are sized to contain 1.8 Liter of CNG at 360 psig, then approximately 2 bladders (45 Liters at STP for each bladder) may be used and still stay within the 5% room volume for a one-car garage. In accordance with an embodiment of the invention, FIG. 5 illustrates a method 200, which may be used for providing compressed natural gas suitable for use in a vehicle by a multi-stage home refueling appliance from a utility supply of natural gas such as by the multi-stage home refueling appliance 10 or multi-stage home refueling appliance 110. The method 200 begins at 202 by mechanically pre-compressing the supply of natural gas to a first pressure by a mechanical compressor in the multi-stage home refueling appliance. It is contemplated that the natural gas may be filtered and/or dried before it is provided to the mechanical pre-compressor.

At 204, the pre-compressed natural gas may be hydraulically compressed to a second pressure, greater than the first pressure by a hydraulic compressor in the multi-stage home appliance. The second pressure may be about ten times greater than the first pressure. For example, the first pressure may be 360 psig and the second pressure may be 3600 psig.

The natural gas compressed to the second pressure may be discharged into a tank of a vehicle. Discharging the natural gas compressed to the second pressure may include supplying at least 8 gallons of gas equivalent of natural gas over a predetermined time period, such as six hours. The mechanically pre-compressing, hydraulically compressing, and discharging will be done multiple times or in multiple batches to supply the 8 gallons of gas equivalent.

Further, to address the vehicle filling time constraints, it is contemplated that the supply of the CNG to the vehicle may take place in a "smart" manner that does not require the full compression of the natural gas in both stages. For example, if it is determined that the pressure in the vehicle tank is less than the first pressure, then the natural gas compressed to the first pressure may be discharged into the tank of the vehicle prior to the discharging of the natural gas compressed to the second pressure. The second stage need only be brought online once the pressure in the vehicle tank approaches the first pressure and rate of fueling of the vehicle tank drops below an acceptable rate. At the extreme, the natural gas compressed to the first pressure may be discharged into the tank of the vehicle until the pressure of natural gas in the vehicle tank equalizes relative to the first pressure. In the above examples, this would include discharging until the pressure in the vehicle tank reaches 360 psig. It is also contemplated that upon the vehicle tank equalizing to the first pressure, the hydraulically compressing may be initiated. In this manner, how far the pressure of the natural gas is increased depends on the fuel tank pressure in the vehicle at any time during the filling stage. If the fuel tank is relatively empty, the fuel tank pressure is not at 3600 psig so the home re-fueling appliance does not have to go all the way to 3600 psig at the early stages of pumping of the gas. Thus, the natural gas pressurization level may be varied depending on the fuel tank pressure at any time of filling.

The second stage may be activated once the rate of refueling of the vehicle tank from the first stage drops below the desired rate. The initiation of the second stage may also include directly supplying the CNG from the second stage as the bladder is compressed, instead of waiting for the complete compression of the bladder. This will further enhance the rate at which the vehicle tank is filled.

If more than two compression stages are used, the filling of the vehicle tank may include directly filling from each stage until the rate of filling of the vehicle tank drops below a desired rate, with the filling being limited by the pressure in the vehicle tank equalizing with the output pressure of the particular stage.

To accomplish the smart filling, a suitable pressure sensor may be placed in the refueling dispenser 150 to detect the pressure in the vehicle tank. Alternatively, the refueling dispenser may include a data connection and the pressure in the vehicle tank may be provided from the vehicle computer to the controller for the home refueling appliance. Another alternative is to monitor the flow rate from each of the compression stages to the vehicle fuel tank, and bring online the next stage as the flow rate for the current stage drops below the desired rate.

The above embodiments provide a variety of benefits including that CNG may be compressed in a home appliance for refueling a vehicle while conforming to a variety of constraints placed on the home system. Further, the use of the multiple hydraulic compressors may minimize the amount of CNG contained in the multi-stage home refueling appliance.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A multi-stage home refueling appliance for supplying compressed natural gas (CNG), comprising:

a first compressing stage comprising a mechanical pre-compressor having a first stage inlet fluidly coupled to a home utility natural gas supply and a first stage outlet;

a second compressing stage comprising a hydraulic compressor having a second stage inlet fluidly coupled to the first stage outlet and a second stage outlet; and a vehicle refueling dispenser fluidly coupled to the second stage outlet and configured to be selectively fluidly coupled to a storage tank of a vehicle; and wherein the first compressing stage is configured to mechanically compress the supplied natural gas to a first pressure, and the second compressing stage is configured to hydraulically compress the natural gas from the first compressing stage to a second pressure, greater than the first pressure.

2. The multi-stage home refueling appliance of claim 1, further comprising a regulator valve fluidly coupled upstream of the refueling dispenser.

3. The multi-stage home refueling appliance of claim 1 wherein the hydraulic compressor further comprises an inflatable bladder fluidly coupled between the second stage inlet and the second stage outlet.

4. The multi-stage home refueling appliance of claim 3 wherein the inflatable bladder is moveable between a deflated state and an inflated state.

5. The multi-stage home refueling appliance of claim 4 wherein the inflatable bladder is unexpandable.

6. The multi-stage home refueling appliance of claim 5 wherein the hydraulic compressor further comprises an encasement surrounding the inflatable bladder and defining a chamber in which the inflatable bladder is received.

7. The multi-stage home refueling appliance of claim 6 where the hydraulic compressor further comprises a source of hydraulic fluid fluidly coupled to the chamber for compressing the inflatable bladder from an inflated state to a deflated state or inflating the inflatable bladder from a deflated to inflated state.

8. The multi-stage home refueling appliance of claim 6 wherein the encasement holds 3.6 liters or less of CNG at a desired pressure range.

9. The multi-stage home refueling appliance of claim 6 wherein the inflatable bladder is a 3.6 Liter inflatable bladder.

10. The multi-stage home refueling appliance of claim 6 wherein the CNG enters the inflatable bladder at 360 psig and is pushed to a vehicle storage tank.

11. The multi-stage home refueling appliance of claim 1 wherein the hydraulic compressor comprises multiple hydraulic compressors.

12. The multi-stage home refueling appliance of claim 11 wherein the multiple hydraulic compressors are fluidly arranged in parallel between the first compressing stage and the vehicle refueling dispenser.

13. The multi-stage home refueling appliance of claim 12, further comprising a valve at the second stage outlet of each of the multiple compressors and where each valve selectively fluidly couples the second stage outlet to the vehicle refueling dispenser.

14. The multi-stage home refueling appliance of claim 12 wherein each of the multiple hydraulic compressors has an inflatable bladder for separating the CNG from hydraulic fluid.

15. The multi-stage home refueling appliance of claim 14 wherein each of the inflatable bladders may be inflated to a predetermined maximum volume equivalent to the encasement volume.

16. The multi-stage home refueling appliance of claim 14 wherein the mechanical pre-compressor further comprises multiple mechanical compressors fluidly coupled in series.

17. The multi-stage home refueling appliance of claim 16 wherein the mechanical pre-compressor includes at least one hermetic refrigerant like compressor.

18. The multi-stage home refueling appliance of claim 17 wherein the mechanical pre-compressor includes series linked hermetic refrigerant compressors that step the CNG to a pressure of 360 psig.

19. The multi-stage home refueling appliance of claim 14 wherein each of the multiple hydraulic compressors further comprises an encasement surrounding each of the inflatable bladders and defines a chamber in which the inflatable bladder is received.

20. The multi-stage home refueling appliance of claim 19 wherein the multiple hydraulic compressors combined hold 3.6 liters or less of CNG at a desired pressure range.

21. The multi-stage home refueling appliance of claim 19 wherein each of the inflatable bladders is a 1.8 Liter inflatable bladder.

22. The multi-stage home refueling appliance of claim 1, further comprising a replaceable filter/dryer fluidly coupled between the home utility natural gas supply and the mechanical pre-compressor.

23. The multi-stage home refueling appliance of claim 1 wherein the first compressing stage compresses the natural gas from the home utility natural gas supply by at least a 10 fold increase in pressure and the second compressing stage compresses the natural gas by another 10 fold increase in pressure.

24. The multi-stage home refueling appliance of claim 1 wherein the natural gas is supplied from the home utility natural gas supply at 3 psig and is compressed by the home refueling appliance to 3600 psig.

25. The multi-stage home refueling appliance of claim 24 wherein the mechanical pre-compressor compresses the CNG to 360 psig.

26. The multi-stage home refueling appliance of claim 24 wherein the home refueling appliance has storage configured to supply at least 8 gallons of gas equivalent over a predetermined time period.

27. The multi-stage home refueling appliance of claim 26 wherein the predetermined time period is 6 hours.

28. A method of providing compressed natural gas suitable for use in a vehicle by a multi-stage home refueling appliance, the method comprising:

mechanically pre-compressing a supply of natural gas from a home utility natural gas supply to a first pressure by a mechanical compressor in the multi-stage home refueling appliance; and hydraulically compressing the pre-compressed natural gas to a second pressure, greater than the first pressure, by a hydraulic compressor in the multi-stage home refueling appliance.

29. The method of claim 28, further comprising filtering the natural gas before mechanical pre-compressing.

30. The method of claim 28 wherein the second pressure is about ten times greater than the first pressure.

31. The method of claim 28 wherein the first pressure is 360 psig and the second pressure is 3600 psig.

32. The method of claim 28, further comprising discharging the natural gas compressed to the second pressure into a tank of a vehicle.

33. The method of claim 32, further comprising discharging the natural gas compressed to the first pressure into the tank of the vehicle prior to the discharging of the natural gas compressed to the second pressure.

34. The method of claim 33 wherein the discharging the natural gas compressed to the first pressure into the tank of the vehicle continues until the pressure of the natural gas in the vehicle tank equalizes relative to the first pressure.

35. The method of claim 34 wherein the hydraulically compressing is initiated upon the equalization.

36. The method of claim 32 wherein the discharging the natural gas compressed to the second pressure comprises supplying at least 8 gallons of gas equivalent of natural gas over a predetermined time period.

37. The method of claim 36 wherein the predetermined time period comprises six hours.

38. The method of claim 36 wherein the supplying the 8 gallons of gas equivalent comprises mechanically pre-compressing, hydraulically compressing, and discharging multiple times to supply the 8 gallons of gas equivalent.

* * * * *